United States Patent [19]

Chang

[11] Patent Number: 4,505,864

[45] Date of Patent: Mar. 19, 1985

[54] DEVICE FOR CARBURETTING AIR AND FUEL

[76] Inventor: Yu-Ting Chang, No. 53, Lane 46, Chung Shan E Rd., Fong-Shan City Kaohsiung Hsieng, Taiwan

[21] Appl. No.: 509,083

[22] Filed: Jun. 29, 1983

[51] Int. Cl.[3] ..... F02M 7/24

[52] U.S. Cl. ..... 261/40; 261/53; 261/121 B

[58] Field of Search ..... 261/121 B, 53, 40

[56] References Cited

U.S. PATENT DOCUMENTS

| | | | |
|---|---|---|---|
| 1,858,835 | 5/1932 | Mabee et al. | 261/121 B |
| 4,007,721 | 2/1977 | Regueiro | 261/121 B |
| 4,080,409 | 3/1978 | Graybill | 261/121 B |
| 4,088,715 | 5/1978 | Graybill | 261/121 B |
| 4,139,581 | 2/1979 | Swanson | 261/121 B |
| 4,275,017 | 6/1981 | Rollins | 261/53 |

FOREIGN PATENT DOCUMENTS

| | | | |
|---|---|---|---|
| 743348 | 3/1933 | France | 261/121 B |

*Primary Examiner*—Tim Miles

*Attorney, Agent, or Firm*—Sughrue, Mion, Zinn, Macpeak and Seas

[57] ABSTRACT

A device for carburetting air and fuel includes, a housing having its wall confining a main air passage of converging-diverging shape, an annular chamber around the diverging portion of the passage, a plurality of tubes for sucking the fuel from the annular chamber and spraying it at the throat portion of the passage. The walls of the tubes are respectively provided with a plurality of openings which are communicated with pilot air inlet passages branching off the main air passage. The on and off positions of the openings are controlled by an automatic pressure sensitive system so as to adjust the fuel-to-air ratio of the fuel feed. A throttle valve is provided at the throat portion for controlling the rate of the fuel-air mixture flow.

1 Claim, 4 Drawing Figures

DEVICE FOR CARBURETTING AIR AND FUEL

BACKGROUND OF THE INVENTION

This invention relates to a device for carburetting air and a hydrocarbon fuel for an internal combustion automobile engine.

It is known that a carbureter is generally comprised of a float chamber having a main fuel outlet with a nozzle directed into an induction pipe adapted to communicate with a fuel intake means of an engine. In the induction pipe a suction is developed and the fuel is drawn from the nozzle in a stream of air flowing through the induction pipe. To control the power outlet and fuel feed of the internal combustion engine, the carbureter is usually further provided with a pilot system for idling, an acceleration system, a choke valve, etc. The pilot system can slow down the engine speed by lowering the rate of the fuel-air mixture feed. If the engine speed is desired to be accelerated, the acceleration system will increase the rate of the air-fuel feed as well as the composition of the fuel in the mixture. As an automobile engine performs through a wide range of loads and speeds, the functions of the carbureter are usually complex. It must control the rate of the fuel air feed and graduate the fuel-air ratio according to the engine requirements in starting, idling, and load and altitude changes. Accordingly, the construction of such a carbureter is rather complicated.

In common practice, when the engine is started, the carbureter must temporarily supply a very rich mixture, i.e. high fuel-to-air ratio fuel feed. For this purpose, it is required to reduce the rate of the air inlet flow by closing the main air inlet with a choke valve provided upstream of the induction pipe so that air is only admitted through a pilot air passage. After the engine is fired, the rich fuel mixture is not suitable as the engine warms up. To adjust the fuel-air ratio, it has been required to open manually the choke valve to increase the rate of the air flow. However, there has been also developed an automatic system that controls the choke valve thermally. The system includes a bimetallic substance to detect the temperature and according to that temperature the choke valve is controlled.

SUMMARY OF THE INVENTION

According to the invention, a device for carburetting air and a fuel is comprised of: a housing having its wall confining a main air passage which has a converging portion, a throat portion and a diverging portion, the converging portion having its one end forming a main air inlet, and the diverging portion having its one end forming a fuel-air mixture outlet; means for regulating the air flow provided at the main air inlet; an annular chamber for receiving a fuel provided in the wall of the housing around the diverging portion and having a float member; means for supplying fuel into the chamber; valve means for interrupting the fuel supply when the float member is raised to a certain level; tube means for sucking the fuel from the chamber and spraying it at the throat portion, the tube means having a portion provided with openings in the tube wall thereof for admitting air therein; means for covering the openings provided around the tube means; means for controlling the covering means responsive to a vacuum pressure developed in the fuel-air mixture outlet and capable of actuating the covering means to expose the openings; and pilot air inlet means branching off the main air passage and provided in the wall of the housing, the pilot inlet means communicating the converging portion and the openings of the tube means.

The air flow regulating means may includes, a throttle plug for operating the holding means to lift and lower the plug so that the rate of the air flow is controlled at the throat portion.

Advantageously, tube means may include, a plurality of tube members provided in the annular chamber. Each of the tube members has its lower portion extended into the fuel through the float member and has its upper portion extended upwardly through the wall of the housing. The upper portion has a nozzle member directed toward the throat portion. In this case, the openings are provided in the wall of the tube above the upper most level of the float member.

The covering means may include a plurality of sleeve members respectively provided around the tube members for covering the openings. Each of the sleeve members has a hole of proper shape that can expose the openings in a sequence of from one to all of the openings upon angular motion of the sleeve member.

The controlling means may include, means for sensing the pressure developed in the fuel-air mixture outlet, and means for responding to the sensing means and actuating the sleeve members to make angular motion. Advantageously, the controlling means may include a bellow to respond to the pressure sensing means and actuating the sleeve members.

An object of the invention is to provide an improved carburetter of simplified construction.

Another object of the invention is to provide a carburetter which has a micro-auto regulation system responsive to the pressure in the fuel-air mixture outlet to control the rate of the fuel feed and the fuel-air ratio so that it saves the fuel consumption, especially during constant speed operation.

The manner in which the above and related objects are accomplished together with the attending advantages and features of the invention appear more fully from the following detailed description and drawings.

DETAILED DESCRIPTION OF THE PREFERRED EMBODIMENT

Figure 1:
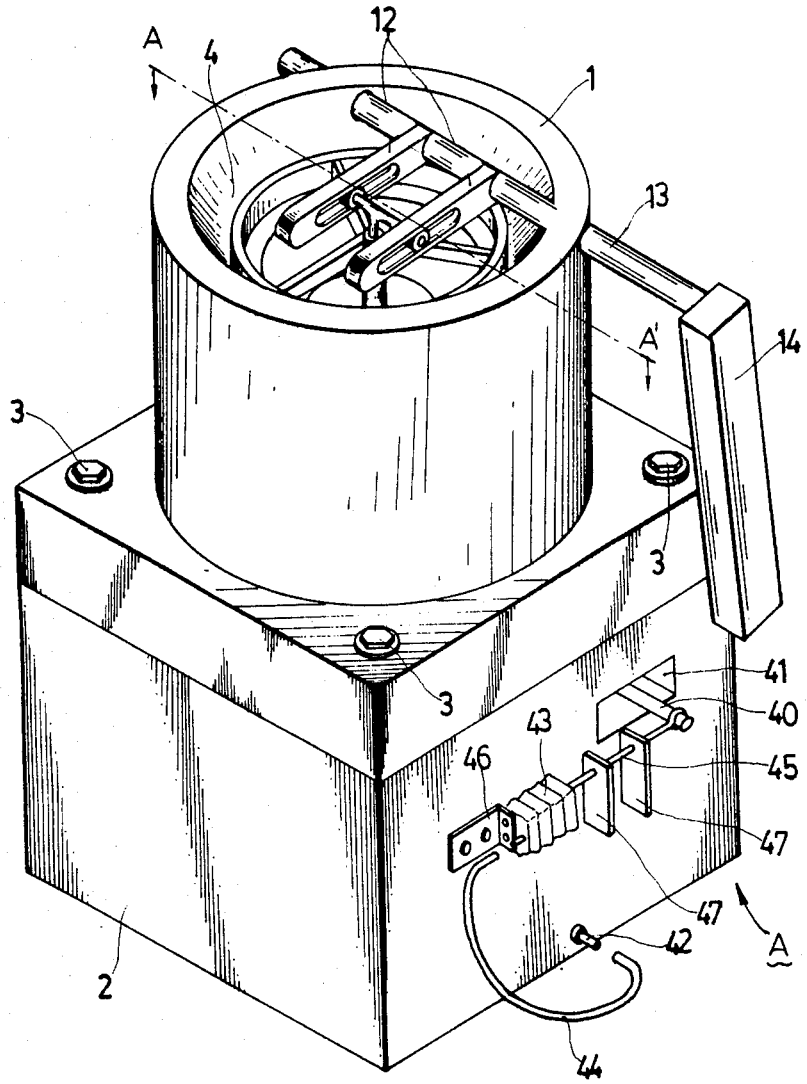
FIG. 1 is a perspective view of a carburetter constructed according to the invention.
Figure 2:
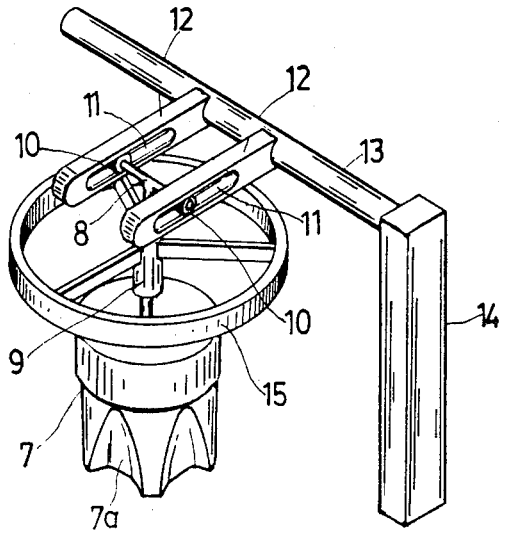
FIG. 2 illustrates main air inlet flow regulating means.
Figure 3:
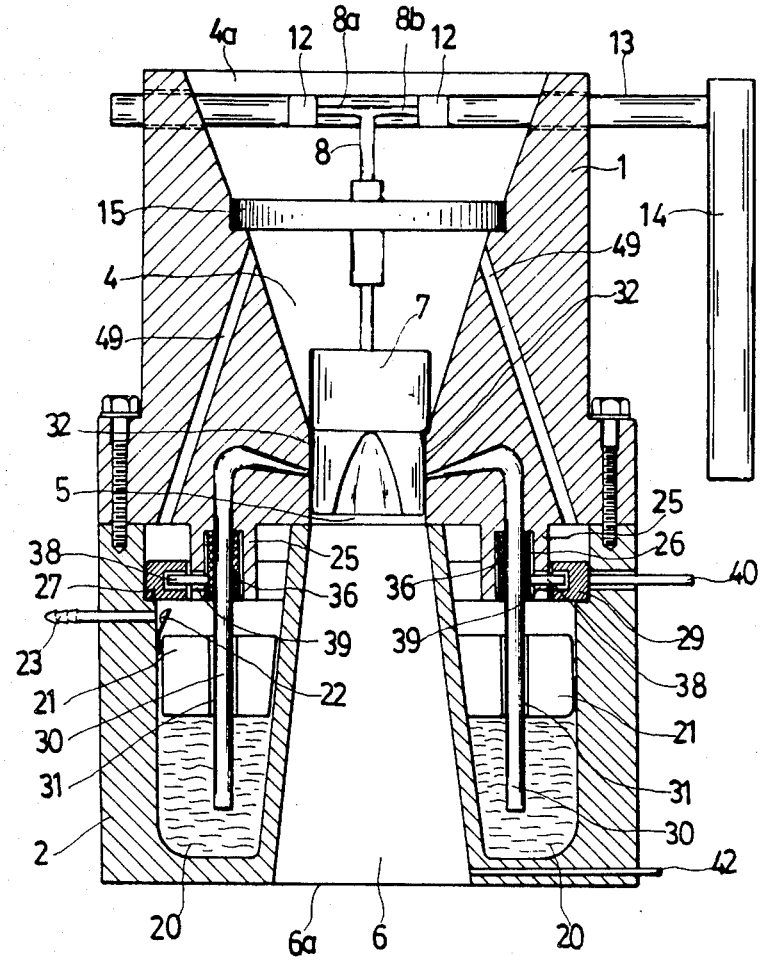
FIG. 3 is a sectional view taken along the line A—A' of FIG. 1.

Referring to FIGS. 1, 2 and 3, there is shown a carburetter which includes a housing made of an upper hollow body 1 and a lower hollow body 2 which are coupled together by means of screws 3. The walls of the bodies 1 and 2 jointly define a main passage including an upper converging portion 4, a throat portion 5, and a diverging portion 6. The converging portion 4 has a main air inlet 4*a* and the diverging portion 6 has a fuel-air mixture outlet 6*a* which is adapted to be communicated with an intake port of an engine (not shown).

At the converging portion 4 is provided an inlet air flow regulating means which includes a throttle plug 7 capable of blocking the throat portion 5. The throttle plug 7 is in the form of a cylinder having recesses 7*a* for providing spaces to allow atomization of the fuel when the plug 7 is closed, and able to place the throat portion 5 in a fully closed position and a widely opened position. It has an upper shank 8 of T-shape which has two arms 8*a* and 8*b* respectively attached with two rollers 10 to roll in grooves 11 of guide members 12. The guide members 12 are affixed to an operating shaft 13 which can be rotated on its axis by an operating rod 14 which can be turned manually by a driver as in the case of a conventional carburetter. The shank 8 is slidably inserted in a tubular member 9 which is attached to a support ring member 15 through radial brackets. When turning the operating rod 14, the movement of the shaft 13 is transmitted to the guide members 12 and the shank 8. Accordingly, the throttle plug 7 is moved along with the vertically movable shank 8 to close and open the throat portion 5. The support ring member 15 which is immobilised guides the throttle plug 7 to be in a coaxial relationship with the converging portion 4.

There is further provided an annular float chamber 20 for receiving a fuel oil in the wall of the lower body 2 around the diverging portion 6. The chamber 20 is provided with an annular float member 21 and communicated with a fuel supply tube 23. A triangle needle valve 22 is pivoted to the wall of the chamber 20 for interrupting the flow of the supplied fuel into the chamber 20, and it is controlled by the float 21 which can push it closed when the fuel level in the chamber 20 reaches a certain height.

At the bottom end of the upper body 1 is provided an annular projection 25 which has an annular groove 26 and is extended into the annular float chamber 20. A guide ring 29 is located on an annular seat 27 formed by the stepped wall of the chamber 20 and is provided around the annular projection 25. It can be appreciated that the rising of the float member 21 is restricted by the lower end of the projection 25 so that the level of the fuel is kept constant below the annular projection 25.

There are further provided a plurality of tubes 30 in the annular chamber 20. The lower portions of the tubes are extended, through apertures 31 of the float member 21, into the fuel oil and the upper portions of the tubes are extended into the annular groove 26 and penetrate into the wall of the upper body 1. At the ends of the upper portions of tubes 30 are respectively provided spray nozzles 32 which are directed toward and communicated with the throat portion 5.

Figure 4:
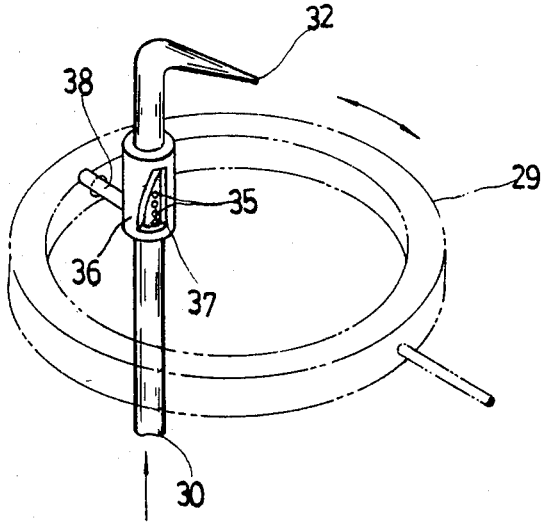
FIG. 4 illustrates a portion of the controlling means according to the invention.

Referring to FIGS. 3 and 4, each of tubes 30 has a plurality of openings 35 in alignment in the wall thereof and around each of tubes 30 is provided a sleeve member 36 for covering the openings 35. Each of sleeve members 36 has a hole 37 of triangular shape to permit the exposure of the openings 35. The openings 35 can be exposed in the sequence of from one to all of them upon angular motion of the sleeve members 36 in one direction. There are further provided guide rods 38 respectively attached to sleeve members 36 through apertures 39 of the annular projection 25 and connected to the guide ring 29 which in turn is connected to an adjusting member 40 extending outwardly of the lower body 2 through a hole 41. The transverse movement of the adjusting member 40 in the hole 41 will cause the angular movement of the ring 29 as well as the sleeve members 36 which control the amount of openings 35 exposed.

As shown in FIGS. 1 and 3, there is provided auto-controlling means A which includes a pressure sensing tube 42 provided in the wall of the body 2 and communicated with the fuel-air mixture outlet 6*a*. The tube 42 is extended outwardly of the body 2 and connected to a bellows 43 through a connecting pipe 44 in a gas tight relationship. The bellows 43 is attached to a fixed bracket 46 with its one end and further connected to the adjusting member 40 through an actuating rod 45. The actuating rod 45 is slidably passed through and supported by two fixed plates 47. The bellows 43 will contact and expand according to the vacuum pressure developed at the air-fuel mixture outlet 6*a* and actuate the adjusting member 40 through the actuating rod 45.

There is further provided a plurality of pilot air inlet passages 49 branching off the main passage in the wall of the body 1. These pilot passages 49 communicate with the converging portion 4 at their upper ends and with the annular chamber 20 at their lower ends. As the annular groove 26 is communicated with the annular chamber 20, the air entering from the passages 49 can enter into the tubes 30 through the openings 35.

Before the engine is started, the adjusting member 40 is set in a position in which one opening 35 or a few openings 35 are opened. Such position occurs when there is no suction in the throat portion 5 and the diverging portion 6 and this is designed specifically during construction of the device. When the engine is started, a suction is developed in the throat portion 5 and the diverging portion 6 due to the suction of the engine. The suction force makes the tubes 30 suck the fuel from the annular chamber 20 which is under atmospheric pressure. The air entering from the pilot passages 49 is also drawn into the tubes 30, mixed with the fuel and then atomized through the spray nozzles 32. The fuel-air mixture at this condition has a high fuel-to-air ratio which is sufficient to initiate the engine operation. After the engine fires the adjusting member 40 adjusts the position of the sleeve members 36 so that a larger quantity of air can be admitted into the tubes 30, as a rich mixture is not necessary at this condition. The adjustment is carried out by the auto-controlling means A. As there is a suction at the diverging portion 6, the bellows 43 contracts and accordingly the actuating rod 45 pulls the adjusting member 40 so that the sleeve members 37 uncover more openings 35.

When it is desired to increase the engine speed, the throttle plug 7 is opened so as to admit a higher rate air flow. To get a proper rich mixture in this higher rate air stream, the auto-controlling means A will adjust the openings 35. At the instance of opening the throttle plug 7, the high vacuum caused by the high velocity air flow causes the bellows 43 to contract, thereby enabling more openings 35 to be left opened. The resultant lean mixture decreases the rotation speed of the engine which in turn causes a lower vacuum in the diverging portion 6. At this time, the bellows 43 expands again and readjusts the sleeve members 37 so that tube 30 supplies a suitable fuel amount to be drawn by the high rate air stream for acceleration.

When the engine is idling, the throttle plug 7 is closed. At the instance of closing the plug 7, a high vacuum is temporarily created at the diverging portion 6. Consequently the bellows 43 contracts; the contracted bellow expands immediately because of the low vacuum in the diverging portion 6 caused by the lower fuel mixture rate. The expansion of the bellows 43 readjusts the sleeve members 37 so that the number of the openings 35 opened makes the tubes 30 supply a mixture of proper fuel-to-air ratio suitable for idling.

It can be noted that the fuel is mixed with air in the tubes 30 before being atomized and therefore the fuel feed supplied by the carbureter has a well-atomized characteristic. When the engine operates at constant speed or with slightly varying speed, the bellows 43 will respond to the vacuum pressure developed at the diverging portion 6 and make the actuating rod 45 adjust the positions of the sleeve members which controls the on and off positions of the openings 35 for adjustment of the fuel-to-air ratio of the fuel feed according to the requirements of the engine. Consequently, the fuel consumption can be saved because of the presence of the auto-controlling means.

It can be seen that the throttle plug 7 effects the functions of both a choke valve provided at the air inlet and a throttle valve provided at the fuel feed outlet of the conventional carburetter. Furthermore, turbulence will not occur in the flow of the fuel feed into the engine due to the absence of the choke valve.

With the invention thus explained, it is apparent that obvious modifications and variations can be made without departing from the scope of the invention. It is therefore intended that the invention be limited only as indicated in the appended claims.

I claim:

1. A device for carburetting air and a hydrocarbon fuel, comprising:

(a) a housing (1, 2) having a wall defining a main air passage having a converging portion (4), a throat portion (5) and a diverging portion (6), said converging portion having one end forming a main air inlet (4*a*), said diverging portion having one end forming a fuel-air mixture outlet (6*a*);

(b) means for regulating the air flow at said main air inlet including a throttle plug (7) for blocking said throat portion, means (8, 9) for holding said plug, and means (11–14) for operating said holding means to lift and lower said plug to control the rate of air flow at said throat portion;

(c) an annular fuel receiving chamber (20) defined in the wall of said housing around said diverging portion and having a float member (21);

(d) means (23) for supplying fuel into said chamber;

(e) valve means (22) for interrupting the fuel supply when said float member is raised to a certain level;

(f) a plurality of tube members (30) for sucking fuel from said chamber and delivering it at said throat portion, each of said tube members having a lower portion extending into the fuel through said float member and having an upper portion provided with a nozzle member (32) directed toward said throat portion, a wall of each tube member being provided with openings (35) for admitting air therein;

(g) a plurality of sleeve members (36) individually provided around said tube members for covering said openings, each of said sleeve members having an aperture (37) shaped to expose said openings in a sequence of from one to all openings upon the angular rotation of said sleeve member;

(h) means for controlling the angular rotation of said sleeve members, said means including a conduit (42) communicating with said fuel-air mixture outlet and extending outwardly of said housing, a bellows member (43) connected with said conduit for sensing the presence developed in said fuel-air mixture outlet, an actuating rod (45) connected to said bellows member, and a ring member 29 provided around and connected to said sleeve members and said actuating rod; and (i) pilot air inlet means (49) branching off said main air passage and provided in the wall of said housing, said pilot air inlet means communicating said converging portion and said openings of said tube means.

* * * * *